US009215525B1

(12) United States Patent
Howarth et al.

(10) Patent No.: US 9,215,525 B1
(45) Date of Patent: Dec. 15, 2015

(54) TRANSDUCER WITH MODIFIABLE PASSIVE COMPONENT

(75) Inventors: Thomas R. Howarth, Newport, RI (US); Kim C. Benjamin, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 1111 days.

(21) Appl. No.: 13/248,337

(22) Filed: Sep. 29, 2011

(51) Int. Cl.
*H04R 17/00* (2006.01)
*H04R 1/44* (2006.01)
*H04R 9/02* (2006.01)

(52) U.S. Cl.
CPC . *H04R 1/44* (2013.01); *H04R 9/027* (2013.01)

(58) Field of Classification Search
CPC ..... B81B 3/0021; H04R 1/20; H04R 1/005; H04R 3/12; H04R 1/403; H04R 1/44; H04R 9/027; H02K 7/10; H02K 33/16; H02K 16/00; H02N 13/00
See application file for complete search history.

(56) References Cited

FOREIGN PATENT DOCUMENTS

WO WO 2014203446 A1 * 12/2014 ..... G01L 1/125

OTHER PUBLICATIONS

Jaehwan Kim, Kyoung-Mi Park; Material Characterization of MR at High Frequencies; Journal Article; 2005; pp. 121-130; Elsevier Ltd.

* cited by examiner

*Primary Examiner* — Daniel Pihulic
(74) *Attorney, Agent, or Firm* — James M. Kasischke; Michael P. Stanley

(57) ABSTRACT

A transducer is provided that converts energy between two forms using active components. The transducer also includes passive components in contact with the active components that perform passive component functions separate from the energy conversion function. The passive components have elastic properties that are modifiable by exposure of the passive component to a magnetic field to selectively control the energy conversion function.

20 Claims, 3 Drawing Sheets

TRANSDUCER WITH MODIFIABLE PASSIVE COMPONENT

STATEMENT OF GOVERNMENT INTEREST

The invention described herein may be manufactured and used by or for the Government of the United States of America for Governmental purposes without the payment of any royalties thereon or therefore.

BACKGROUND OF INVENTION

1) Field of the Invention

The present invention is directed to transducers.

2) Description of Prior Art

Transducers are devices that convert one form of energy into another form of energy. For example, a speaker converts electrical energy to sound or sound waves. The reverse would be the conversion of sound into electrical energy, which is known as a microphone. In addition to converting energy in a single direction, transducers can convert energy in two directions. For example, a single device could function as both a speaker and a microphone, or given transducer can be switched between operating in either a transmit mode and receive mode.

Generally, a transducer includes two types of components (active components and passive components). These components can be arranged as layers in the transducer. Active layers contribute to the energy conversion of the transducer. Passive layers compliment the active layers, but do not contribute to the energy conversion. For example, the passive layer can be a support for an active layer. Therefore, the materials and configuration of passive layers are chosen to have qualities that enhance the active layer performance. However, the desired qualities of the passive layer are different depending on whether the transducer is being used in transmit mode or receive mode. Consequently, current passive layers only compliment an active layer in a single mode of operation, (e.g., either transmit mode or receive mode).

Therefore, a transducer is desired that includes passive components or passive layers that compliment the active components of active layers of the transducer and therefore enhance the overall performance of the transducer in two modes of operation (e.g., transmit mode to receive mode).

SUMMARY OF THE INVENTION

Exemplary embodiments of transducers in accordance with the present invention contain passive components constructed from materials that can be selectively configured to compliment the active components of the transducer in two directions of energy conversion. In one embodiment, the materials of the passive components change their elastic properties when exposed to an applied magnetic field. These materials include magnetorheological materials and magnetoviscoelastic materials, which respectively display a large variation in viscosity and elastic modulus when exposed to a magnetic field.

In accordance with one exemplary embodiment, the present invention is directed to a transducer having an energy conversion function that includes a transmit mode and a receive mode. The transducer includes a passive component having a passive component function that is separate from the energy conversion function of the transducer and an elastic property modifiable by exposure to a magnetic field to selectively compliment the energy conversion function in the transmit mode or the receive mode. In one embodiment, exposure of the passive component to the magnetic field yields up to approximately a forty percent change in the elastic property. This elastic property includes elastic modulus and viscosity.

In one embodiment, the passive component is a solid polymer having a plurality of ferrous particles distributed in the solid polymer. In another embodiment, this solid polymer is a magnetoviscoelastic polymer. In this solid polymer, the ferrous particles have a first organized alignment in the solid polymer and a second disorganized alignment in the solid polymer upon exposure to the magnetic field.

In yet another embodiment, the passive component is a liquid polymer having a plurality of ferrous particles distributed in the liquid polymer. In one embodiment, this liquid polymer is a magnetorheological polymer. The ferrous particles in this liquid polymer have a first disorganized alignment in the liquid polymer and a second organized alignment in the liquid polymer upon exposure to the magnetic field.

Suitable ferrous particles for use in the solid or liquid polymer include iron, nickel, cobalt, iron oxide, iron cobalt, iron nickel, iron silicon, manganese zinc ferrite, zinc nickel ferrite, chrome oxide, iron nitride, a vanadium alloy, a tungsten alloy, a copper alloy, a manganese alloy and combinations thereof.

In another exemplary embodiment, the present invention is directed to a transducer having an active component with an active component function that is at least a portion of an energy conversion function of the transducer. The transducer also includes a passive component in communication with the active component.

This passive component has a passive component function that is separate from the energy conversion function of the transducer. The passive component function affects the active component function. In addition, the passive component has an elastic property that is modifiable by exposure to a magnetic field. In one embodiment, exposure of the passive component to the magnetic field yields up to approximately a forty change percent in the elastic property. This elastic property is an elastic modulus or viscosity.

The passive component can include a solid magnetorheological fluid polymer or a magnetoviscoelastic solid polymer. In addition, the passive component includes a plurality of ferrous particles. These ferrous particles include iron, nickel, cobalt, iron oxide, iron cobalt, iron nickel, iron silicon, manganese zinc ferrite, zinc nickel ferrite, chrome oxide, iron nitride, vanadium alloy, tungsten alloy, copper alloy, manganese alloy and combinations thereof.

In one embodiment, the ferrous particles in the passive layer have a disorganized alignment and an organized alignment. The ferrous particles switch between the disorganized alignment and the organized alignment upon exposure to the magnetic field; thereby, modifying the elastic property of the passive layer.

In one embodiment, the transducer includes a plurality of active components arranged as a plurality of active component layers and a plurality of passive components arranged as a plurality of passive component layers. Each passive component layer is in communication with at least one of the active component layers to affect the active component function of that active component layer.

Exemplary embodiments of the present invention are also directed to a method for using a transducer for energy conversion. In this method, an active component of the transducer transfers energy between a first form or energy and a second form of energy. A passive component of the transducer that is in communication with the active component is used to compliment the function of the active component when transferring the energy between the first form of energy and the second form of energy. A magnetic field is applied to the passive component to change an elastic property of the passive component. The effect of the passive component on the transfer of energy by the active component between the first form of energy and the second form of energy is dependent upon the elastic property of the passive component.

DETAILED DESCRIPTION OF THE INVENTION

Exemplary embodiments of systems and methods in accordance with the present invention provide for the transfer or conversion of energy between a first form of energy and a second form of energy using a transducer having an energy conversion function. This transfer of energy includes a transfer from the first form of energy to the second form of energy and from the second from of energy to the first form of energy. The direction of transfer is reversible and selectable by the user of the transducer.

Suitable energy conversion functions transfer one form of energy to another form of energy including, but not limited to, thermal energy, chemical energy, electrical energy, radiant energy, nuclear energy, magnetic energy, elastic energy, sound energy, mechanical energy and luminous energy. In one embodiment, the first form of energy is sound or sound waves and the second form of energy is electrical energy. The transducer has an energy conversion function with a transmit mode that converts the electrical energy to sound, transmitting the sound; thereby, waves through the air. The transducer also has a receive mode that receives sound waves from the air and converts the sound to electrical energy.

Suitable types of transducers include, but are not limited to, electromagnetic transducers such as antennae, cathode ray tubes, fluorescent lamps, light bulbs, magnetic cartridges, photo detectors, photo resistors, tape heads and Hall effect sensors, electrochemical transducers such as pH probes, electro-galvanic fuel cells and hydrogen sensors, electromechanical transducers such as electro active polymers, galvanometers, microelectromechanical systems, rotary motors, linear motors, vibration powered generators, potentiometers, load cells, accelerometers, strain gauges, string potentiometers, air flow sensors and tactile sensors, electro acoustic transducers such as loudspeakers, earphones, microphones, tactile transducers, piezoelectric crystals, geophones, gramophone pickups, hydrophones and sonar transponders, photoelectric transducers such as laser diodes, light-emitting diodes, photodiodes, photo resistors, phototransistors and photomultiplier tubes, electrostatic transducers, thermoelectric transducers such as resistance temperature detectors, thermocouples, Peltier coolers and thermistors and radioacoustic transducers such as Geiger-Müller tubes and radio receivers.

Figure 1:
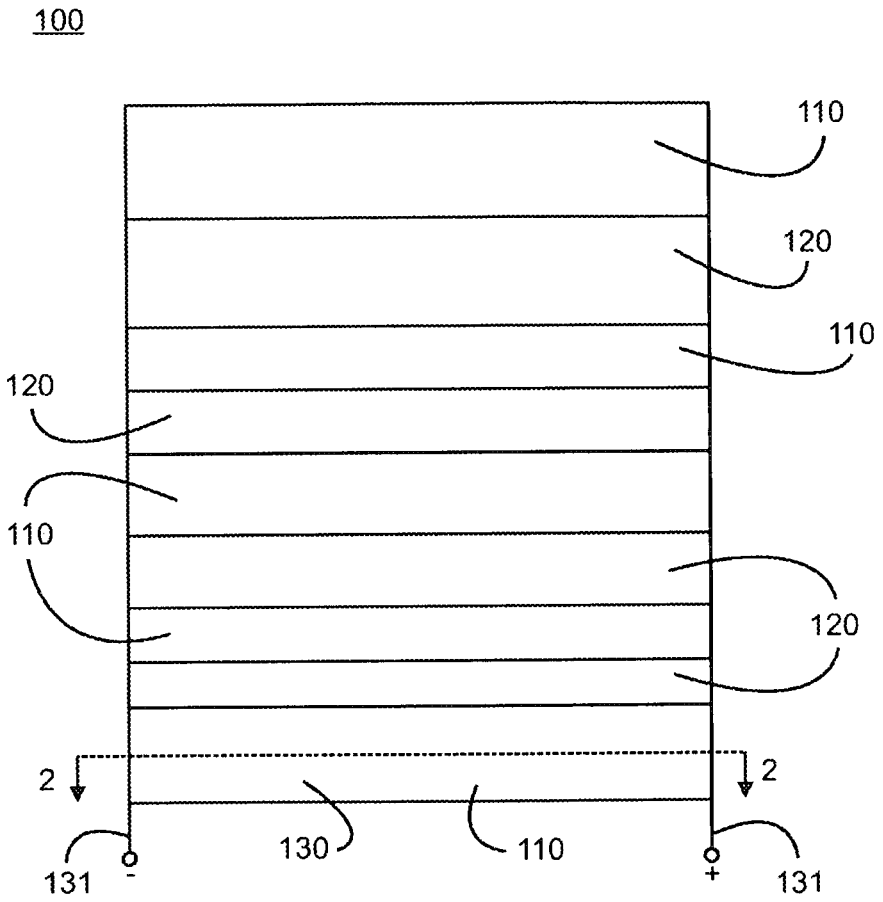
FIG. 1 is a schematic illustration of an embodiment of a transducer in accordance with the present invention.

Referring to FIG. 1, an exemplary embodiment of a transducer 100 in accordance with the present invention is illustrated. As illustrated, the transducer 100 includes at least one and preferably a plurality of active components 110. The active components 110 each contribute to an active component function or energy conversion functionality of the transducer 100. Therefore, a given active component 110 performs at least a portion of the energy conversion function of the transducer 100. Suitable active components include, but are not limited to, transistors, diodes, piezoelectric materials, generators, photovoltaic cells and thermocouples.

The transducer 100 also includes at least one and preferably a plurality of passive components 120 disposed within the transducer. Each passive component 120 is in communication with at least one of the active components 110. This communication includes, but is not limited to, physical contact, electrical contact and fluid communication. As illustrated, the active components 110 and passive components 120 are configured as alternating active layers and passive layers. However, the transducers 100 in accordance with the present invention are not limited to arrangements of layers of active components and passive components. In addition, the layers do not all have to alternate, and two active layers or two passive layers can be adjacent layers in the transducer 100.

Each passive component 120 is separate from and is not involved in the energy conversion functionality of the transducer 100. Instead, each passive component 120 contributes a passive component function to the transducer 100. These passive component functions including spacing, insulation, filtering, polarizing, focusing, supporting, heating, cooling, dampening and weighting, among others. Therefore, the passive component function of a given passive component 120 is selected to affect and to compliment the active component function of the active component 110 to which it is in communication and therefore to enhance the overall energy transfer functionality of the transducer 100. Suitable passive components include, but are not limited to lenses, strain gauges, inductors, conductors, insulators, resistors and transformers.

The ability of the passive components 120 to compliment the active functions of the active components 110 depends upon the mode of operation of the transducer 100 (i.e., the direction of energy transfer, and the physical properties of the passive components).

For example, a more flexible passive component is preferable for one mode of operation, and a more rigid passive component is preferable for the opposite mode of operation. Therefore, the passive components 120 of the present invention are configured to change their physical properties selectively, controllable and reversibly. These physical properties are changed depending on the mode of operation or direction of energy transfer of the transducer 100.

Suitable physical properties of the passive components 120 that can be modified are the elastic properties of the passive component. These elastic properties include, but are not limited to, yield strength, stress, strain, elastic modulus and viscosity. Preferably, the elastic property to be modified is elastic modulus or viscosity.

The transducer 100 includes a mechanism to selectively control or to selectively modify the elastic properties of the passive components 120. In addition, the passive components 120 are constructed from materials that respond to the mechanism used to control the elastic properties of the passive component.

In one embodiment, the passive components 120 are constructed from materials having elastic properties that are modifiable by exposure to a magnetic field. In another embodiment, a magnetic field is applied to the passive components 120 to modify the elastic properties of the passive components to selectively compliment the energy conversion function of the transducer 100 in either the transmit mode or the receive mode.

Figure 2:
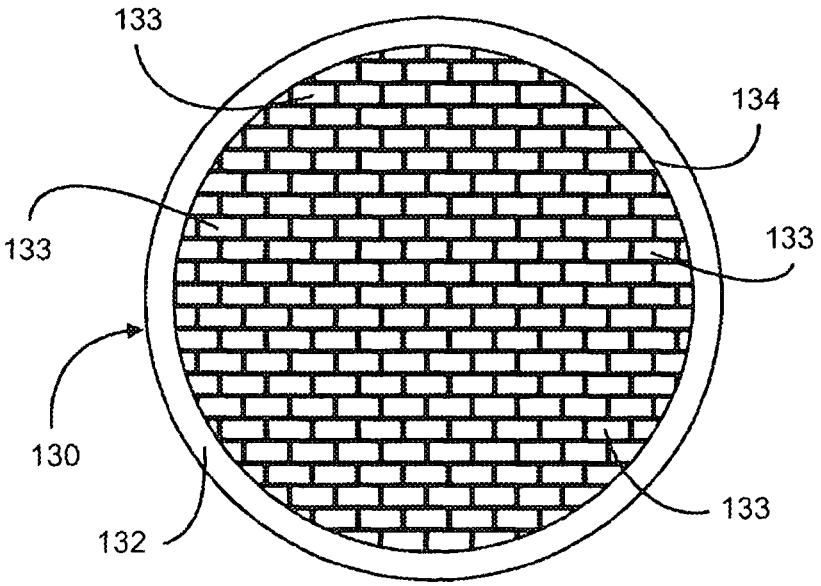
FIG. 2 is view through reference line 2-2 of FIG. 1.
Figure 3:
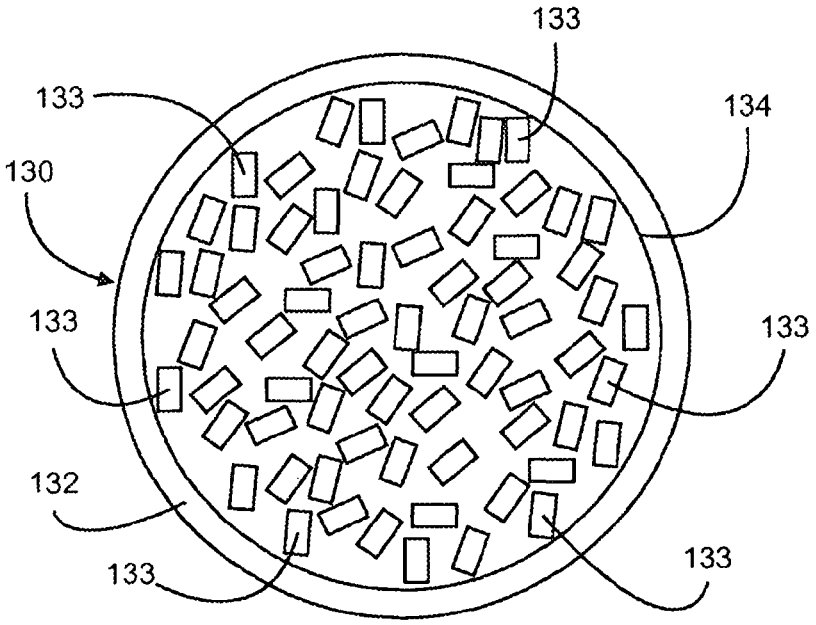
FIG. 3 is the view of FIG. 2 with the passive layer having a modified elastic property.

As illustrated, a given passive layer is configured as a support layer 130 in contact with an active layer in the transducer. The elastic properties of the passive support layer 130 will affect the flexibility of the active layer to which it is in contact. As shown in FIGS. 2 and 3, the passive support layer 130 is surrounded by a coil of wire 132 that is used to generate a magnetic field that is imparted to the central material 134 that is changeable to an elastic property. Suitable materials for the coil of wire include copper and aluminum. A pair of electric contacts 131 (FIG. 1) are used in contact with the coil of wire in order to supply the required current to generate the magnetic field. Although illustrated as a coil of wire incorporated into the transducers or into the passive layer, the magnetic field can be generated from any suitable-source including sources external to the transducer.

Suitable materials that change their elastic property upon exposure to a magnetic field include, but are not limited to, magnetorheological polymers and magnetoviscoelastic polymers. These materials include a plurality of ferrous particles 133. These ferrous materials are sensitive to the applied magnetic field. Suitable ferrous particles includes, but are not limited to, iron, nickel, cobalt, iron oxide, iron cobalt, iron nickel, iron silicon, manganese zinc ferrite, zinc nickel ferrite, chrome oxide, iron nitride, vanadium alloy, tungsten alloy, copper alloy, a manganese alloy and combinations thereof.

Although illustrated as rectangular particles, the particles are not limited to rectangular particles but can be particles having any suitable shape to include spherical particles as well randomly shaped particles and particles having other geometric shapes. Preferably, the material for the passive layer changes its elastic property by up to approximately forty percent when exposed to the magnetic field.

Selective application of the magnetic field to the material of the passive layer, for example by turning on and off the current through the coil of wire 132, causes the ferrous particles 133 to move between an organized state as illustrated in FIG. 2 and a disorganized state as illustrated in FIG. 3. Changing the relative organization of the ferrous particles 133 changes an elastic property of the material.

In one embodiment, the passive component material is a magnetorheological liquid polymer containing ferrous particles that are initially in a disorganized state is shown in FIG. 3. The applied magnetic field causes the particles to align as in FIG. 2, changing the viscosity of the magnetorheological liquid polymer containing passive layer.

In another embodiment the passive component material is a magnetoviscoelastic solid polymer where the ferrous particles are organized prior to curing of the polymer so that the ferrous particles are initially in an organized state within the solid polymer as shown in FIG. 2. Application of a reversed magnetic field to the cured solid polymer causes the ferrous particles to become disorganized as shown in FIG. 3. This produces a change in stiffness of the passive layer or a modification of the elastic modulus of the passive layer.

Figure 4:
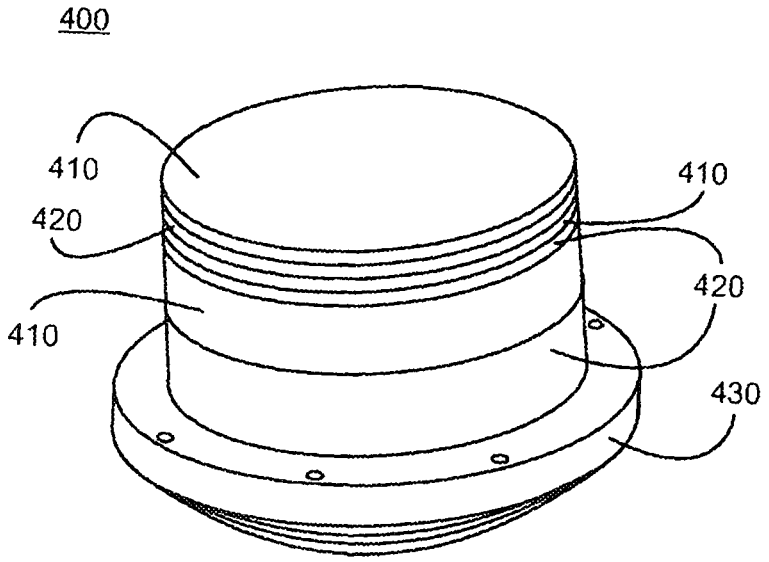
FIG. 4 is a perspective view of another embodiment of a transducer in accordance with the present invention.
Figure 5:
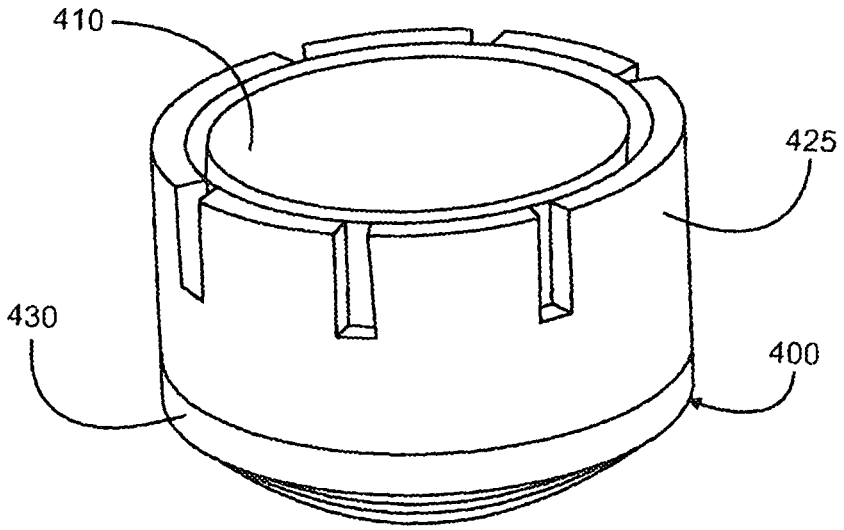
FIG. 5 is a perspective view of the transducer of FIG. 4 with a housing.

Referring to FIG. 4, an exemplary embodiment of a transducer 400 in accordance with the present invention is illustrated. The transducer 400 includes a plurality of alternating active layers 410 and passive layers 420. The active layers and passive layers are configured and constructed of materials as discussed herein. In addition, the active and passive layers are adhesively bonded together. As shown in FIG. 5, the adhesively bonded layers are encapsulated in a mountable housing 425. Electrical connections (not shown) to the active layers are passed from the encapsulated region to the other side of a water proof bulkhead 430 (See FIG. 4).

As described above, a coil of wire associated with one or more of the passive layers induce a magnetic field in the associated passive layers. When the passive layer is a magnetoviscoelastic solid polymer, the ferrous particles in its quiescent state remain in their organized alignment, yielding one extreme of the elastic modulus of the passive layer. When the coil of wire is energized and the magnetic field is present, the organized of columnar nature of the ferrous particles is destroyed, yielding a disorganized ferrous particle structure and an opposite extreme for the elastic modulus. Therefore, the passive layer is moved between these organized and disorganized states to present the appropriate backing stiffness to an active layer in either one of two directions of energy transfer (e.g., transmit or receive). Switching the magnetic field on-and-off or switching the particle alignment between organized and disorganized can be step wise or time varying depending on the desires stiffness versus time function.

Exemplary embodiments in accordance with the present invention are also directed to a method for converting energy. In accordance with this method, an active component function is performed using an active component of a transducer. The active component function is at least a portion of an energy conversion function of the transducer. Passive components of the transducer are used to perform a passive component function that is separate from the energy conversion function of the transducer. However, this passive component function affects the active component function; thereby, enhancing the overall function of the transducer. In order to benefit the active component function of the active components in two directions of energy transfer; the elastic properties of the passive components are modified-preferably by exposing the passive components to a magnetic field.

In one embodiment, a mechanism that includes a coil of copper wire surrounding the passive component introduces a magnetic field to that passive component. An elastic property of that passive component (for example: the elastic modulus or viscosity) changes as a result of this exposure to the magnetic field.

It will be understood that many additional changes in details, materials, steps, and arrangements of parts which have been described herein and illustrated in order to explain the nature of the invention, may be made by those skilled in the art within the principle and scope of the invention as expressed in the appended claims.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A transducer comprising:

an energy conversion function having a transmit mode and a receive mode; and a passive component disposed within the transducer with said passive component having a passive component function separate from said energy conversion function of said transducer and an elastic property modifiable by exposure to a magnetic field to selectively compliment said energy conversion function in the transmit mode and the receive mode.

2. The transducer of claim 1, wherein exposure of said passive component to the magnetic field yields up to approximately a forty percent change in the elastic property.

3. The transducer of claim 1, wherein the elastic property comprises at least one of elastic modulus and viscosity.

4. The transducer of claim 1, wherein the passive component further comprises:

a solid polymer; and a plurality of ferrous particles distributed in said solid polymer.

5. The transducer of claim 4, wherein said solid polymer is a magnetoviscoelastic polymer.

6. The transducer of claim 4, wherein said ferrous particles upon exposure to the magnetic field comprise a first organized alignment in said solid polymer and a second disorganized alignment in said solid polymer.

7. The transducer of claim 4, wherein the wherein said plurality of ferrous particles comprises iron, nickel, cobalt, iron oxide, iron cobalt, iron nickel, iron silicon, manganese zinc ferrite, zinc nickel ferrite, chrome oxide, iron nitride, vanadium alloy, tungsten alloy, copper alloy, manganese alloy or combinations thereof.

8. The transducer of claim 1, wherein said passive component further comprises:

a liquid polymer; and a plurality of ferrous particles distributed in said liquid polymer.

9. The transducer of claim 8, wherein said liquid polymer is a magnetorheological polymer.

10. The transducer of claim 8, wherein said ferrous particles upon exposure to the magnetic field comprise a disorganized alignment in said liquid polymer and a organized alignment in said liquid polymer upon exposure to the magnetic field.

11. The transducer of claim 8, wherein the wherein said plurality of ferrous particles comprises iron, nickel, cobalt, iron oxide, iron cobalt, iron nickel, iron silicon, manganese zinc ferrite, zinc nickel ferrite, chrome oxide, iron nitride, vanadium alloy, tungsten alloy, copper alloy, manganese alloy or combinations thereof.

12. A transducer comprising:

an active component having an active component function that includes a portion of an energy conversion function of said transducer; and a passive component in communication with said active component, the passive component having a passive component function separate from said energy conversion function of said transducer with said passive component function affecting said active component function and having an elastic property modifiable by exposure to a magnetic field.

13. The transducer of claim 12, wherein exposure of said passive component to the magnetic field yields up to approximately a forty percent change in the elastic property.

14. The transducer of claim 12, wherein said passive component is a solid magnetorheological fluid polymer.

15. The transducer of claim 12, wherein said passive component is a magnetoviscoelastic solid polymer.

16. The transducer of claim 12, wherein said passive component comprises a plurality of ferrous particles.

17. The transducer of claim 16, wherein said wherein the plurality of ferrous particles comprises iron, nickel, cobalt, iron oxide, iron cobalt, iron nickel, iron silicon, manganese zinc ferrite, zinc nickel ferrite, chrome oxide, iron nitride, a vanadium alloy, a tungsten alloy, a copper alloy, a manganese alloy or combinations thereof.

18. The transducer of claim 16, wherein said ferrous particles comprise a disorganized alignment and an organized alignment;

wherein said ferrous particles when exposed to the magnetic field are capable of switching between the disorganized alignment and the organized alignment to modify the elastic property.

19. The transducer of claim 12, further comprising:

a plurality of active components arranged as a plurality of active component layers; and a plurality of passive components arranged as a plurality of passive component layers, each passive component layer in communication with at least one of said active component layers to affect said active component function of that active component layer.

20. A method for using a transducer for energy conversion, said method comprising the steps of:

transferring energy with an active component of the transducer between a first form of energy and a second form of energy;

using a passive component of the transducer in communication with the active component to compliment the function of the active component when transferring the energy between the first form of energy and the second form of energy; and applying a magnetic field to the passive component to change an elastic property of the passive component wherein the effect of the passive component on the transfer of energy by the active component between the first form of energy and the second form of energy is dependent upon the elastic property of the passive component.

* * * * *